US009129547B2

(12) United States Patent
Zeng

(10) Patent No.: US 9,129,547 B2
(45) Date of Patent: Sep. 8, 2015

(54) SPECTRAL COLOR REPRODUCTION USING A HIGH-DIMENSION REFLECTIVE DISPLAY

(71) Applicant: QUALCOMM Incorporated, San Diego, CA (US)

(72) Inventor: Huanzhao Zeng, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 260 days.

(21) Appl. No.: 13/827,890

(22) Filed: Mar. 14, 2013

(65) Prior Publication Data

US 2014/0267365 A1 Sep. 18, 2014

(51) Int. Cl.

| | |
|---|---|
| ***G09G 5/02*** | (2006.01) |
| ***G09G 3/20*** | (2006.01) |
| ***G09G 3/34*** | (2006.01) |

(52) U.S. Cl.

CPC ..... *G09G 5/02* (2013.01); *G09G 3/2003* (2013.01); *G09G 3/2066* (2013.01); *G09G 3/346* (2013.01); *G09G 3/3466* (2013.01); *G09G 2340/0428* (2013.01); *G09G 2340/06* (2013.01)

(58) Field of Classification Search

CPC ..... H04N 1/60; H04N 1/6002; G09G 5/02; G09G 5/06; G09G 3/2018; G09G 3/2059; G09G 3/2602; G09G 3/2066; G09G 3/3629; G06T 15/503; G06T 2200/12

See application file for complete search history.

(56) References Cited

U.S. PATENT DOCUMENTS

| | | | | |
|---|---|---|---|---|
| 5,726,672 | A | 3/1998 | Hernandez et al. | |
| 7,403,180 | B1 | 7/2008 | Silverstein et al. | |
| 8,334,883 | B2 | 12/2012 | Tin | |
| 2009/0040205 | A1 | 2/2009 | Scheibe | |
| 2011/0074808 | A1 | 3/2011 | Huang et al. | |
| 2012/0154423 | A1 * | 6/2012 | Barnhoefer et al. | 345/590 |
| 2013/0027440 | A1 | 1/2013 | Martin et al. | |
| 2013/0135335 | A1 * | 5/2013 | Govil | 345/589 |

FOREIGN PATENT DOCUMENTS

| | | | |
|---|---|---|---|
| EP | 1542450 | A1 | 6/2005 |
| WO | WO-2008057324 | A1 | 5/2008 |

OTHER PUBLICATIONS

Pattanaik S.N., et al., "Time-Dependent Visual Adaptation for Fast Realistic Image Display," Proceedings of the 27th annual conference on Computer graphics and interactive techniques, 2000, pp. 47-54.

* cited by examiner

*Primary Examiner* — Antonio A Caschera

(74) *Attorney, Agent, or Firm* — Foley & Lardner LLP

(57) ABSTRACT

A method for color reproduction in a display device includes receiving spectral color input to be displayed on the display device. The method additionally includes selecting a primary from a plurality of available primaries that is a closest match of a spectral reflectance of the spectral color input, wherein each of the plurality of available primaries is assigned an association with an associated spectral reflectance. The method also includes displaying the selected primary in a temporal frame of a set of temporal frames for a pixel and passing remaining spectral errors to a next temporal frame of the set of temporal frames. The method further includes passing remaining spectral errors to neighbor pixels for spatial error diffusion at each spectral band after all temporal frames of the set of temporal frames are used.

40 Claims, 6 Drawing Sheets

SPECTRAL COLOR REPRODUCTION USING A HIGH-DIMENSION REFLECTIVE DISPLAY

BACKGROUND

1. Field

Aspects of the present disclosure relate generally to spectral color reproduction, and more particularly, to spectral color reproduction using a high-dimension reflective display.

2. Background

Interferometric modulator display (IMOD), is a technology used in electronic visual displays that can create various colors via interference of reflected light. The color is selected with an electrically switched light modulator comprising a microscopic cavity that is switched on and off using driver integrated circuits similar to those used to address liquid crystal displays (LCD). An IMOD-based reflective flat panel display includes hundreds of thousands of individual IMOD elements, each one a microelectromechanical systems (MEMS)-based device.

Each IMOD pixel selectively absorbs and/or reflects light using the principles of optical interferometric absorption. An IMOD display element may include a pair of conductive plates, one of which has a high reflectance and one is partially absorptive. The position of one plate in relation to another can change the spectrum of the reflected light from the IMOD display element. The gap between two plates is sometime called air-gap. If the air-gap of each pixel can be dynamically changed, the IMOD display is called analog IMOD display or AiMOD (Analog Interferometric Modulation) display. The number of primaries is determined by the available positions (air-gaps) configured for the device. When not being addressed, an IMOD display consumes very little power. Unlike conventional back-lit liquid crystal displays, the IMOD is clearly visible in bright ambient light such as sunlight.

Each basic element of an AiMOD-based display changes reflective color spectrum independently by changing the air-gap. Depending on the spectrum it reflects and/or absorbs, the primary can be white, black, or a color. Each of white, black, or a color is named a primary. Each pixel is capable of changing from one primary color to another, but it is not able to change the brightness level. Elements are organized into a rectangular array in order to produce a display screen.

As each element reflects only a certain amount of light, grouping several elements of the same color together as subpixels allows different brightness levels for a pixel based on how many elements are reflective at a particular time. Multiple color displays are created by using subpixels, each designed to reflect a specific different color. Multiple elements of each color are generally used to both give more combinations of displayable color (by mixing the reflected colors) and to balance the overall brightness of the pixel. Another approach to produce multi-levels of brightness is to use temporal modulation and/or spatial dithering.

Because elements only use power in order to switch among primary states (no power is needed to reflect or absorb light hitting the display once the element is either reflecting or absorbing), IMOD-based displays potentially use much less power than displays that generate light and/or need constant power to keep pixels in a particular state. Being reflective displays, they require an external light source (such as daylight or a lamp) to be readable, just like paper or other electronic paper technologies.

Most current displays use colorimetric color characterization, which produce colors to match original colors colorimetrically. Such a display, which is calibrated to produce colorimetric colors under an illuminant, is not suitable for spectral reproduction. In the color characterization for AiMOD displays, the illuminant dependency is revealed. This illuminant dependency is a more serious problem in a reflective display than in an emissive display (e.g., LCD display).

SUMMARY

Techniques for spectral color reproduction using a high-dimension reflective display are disclosed. Since an AiMOD display has many more primaries (or higher dimensions) than any other displays, a new color reproduction method is developed for spectral color reproduction. With this new approach, the illuminant dependency of a source spectral color becomes the same as that produced by the AiMOD display, as far as the color is within the display color gamut. Thus, the color of a real object that changes under a different illuminant will be the same as that produced by the display.

In an aspect, a method for color reproduction in a display device includes receiving spectral color input to be displayed on the display device. The method additionally includes selecting a primary from a plurality of available primaries that is a closest match of a spectral reflectance of the spectral color input, wherein each of the plurality of available primaries is assigned an association with an associated spectral reflectance. The method also includes displaying the selected primary in a temporal frame of a set of temporal frames for a pixel and passing remaining spectral errors to a next temporal frame of the set of temporal frames. The method further includes passing remaining spectral errors to neighbor pixels for spatial error diffusion at each spectral band after all temporal frames of the set of temporal frames are used.

In another aspect, an apparatus for color reproduction in a display device includes means for receiving spectral color input to be displayed on the display device. The apparatus also includes means for selecting a primary from a plurality of available primaries that is a closest match of a spectral reflectance of the spectral color input, wherein each of the plurality of available primaries is assigned an association with an associated spectral reflectance. The apparatus additionally includes means for displaying the selected primary in a temporal frame of a set of temporal frames for a pixel and passing remaining spectral errors to a next temporal frame of the set of temporal frames. The apparatus further includes means for passing remaining spectral errors to neighbor pixels for spatial error diffusion at each spectral band after all temporal frames of the set of temporal frames are used.

In an additional aspect, a computer program product includes a computer-readable medium. The computer-readable medium includes code for receiving spectral color input to be displayed on the display device. The computer-readable medium additionally includes code for selecting a primary from a plurality of available primaries that is a closest match of a spectral reflectance of the spectral color input, wherein each of the plurality of available primaries is assigned an association with an associated spectral reflectance. The computer-readable medium also includes code for displaying the selected primary in a temporal frame of a set of temporal frames for a pixel and passing remaining spectral errors to a next temporal frame of the set of temporal frames. The computer-readable medium further includes code for passing remaining spectral errors to neighbor pixels for spatial error diffusion at each spectral band after all temporal frames of the set of temporal frames are used.

In a further aspect, a display device includes at least one processor and a memory coupled to the at least one processor.

The at least one processor is configured to receive spectral color input to be displayed on the display device. The at least one processor is additionally configured to select a primary from a plurality of available primaries that is a closest match of a spectral reflectance of the spectral color input, wherein each of the plurality of available primaries is assigned an association with an associated spectral reflectance. The at least one processor is also configured to display the selected primary in a temporal frame of a set of temporal frames for a pixel and passing remaining spectral errors to a next temporal frame of the set of temporal frames. The at least one processor is further configured to pass remaining spectral errors to neighbor pixels for spatial error diffusion at each spectral band after all temporal frames of the set of temporal frames are used.

Various aspects and features of the disclosure are described in further detail below.

DETAILED DESCRIPTION

Figure 1:
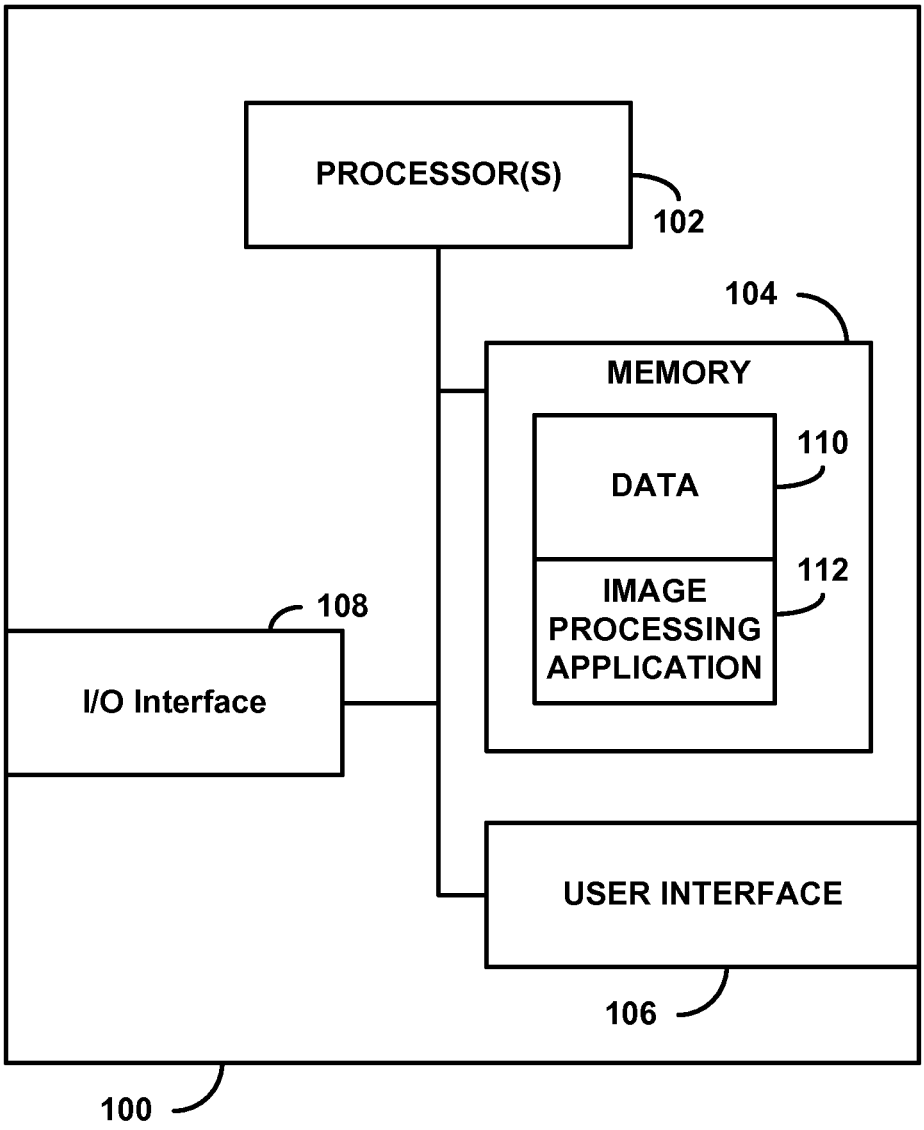
FIG. 1 is a block diagram conceptually illustrating an example of an image display apparatus implementing a spectral reproduction process in accordance with aspects of the present disclosure.
Figure 2A:
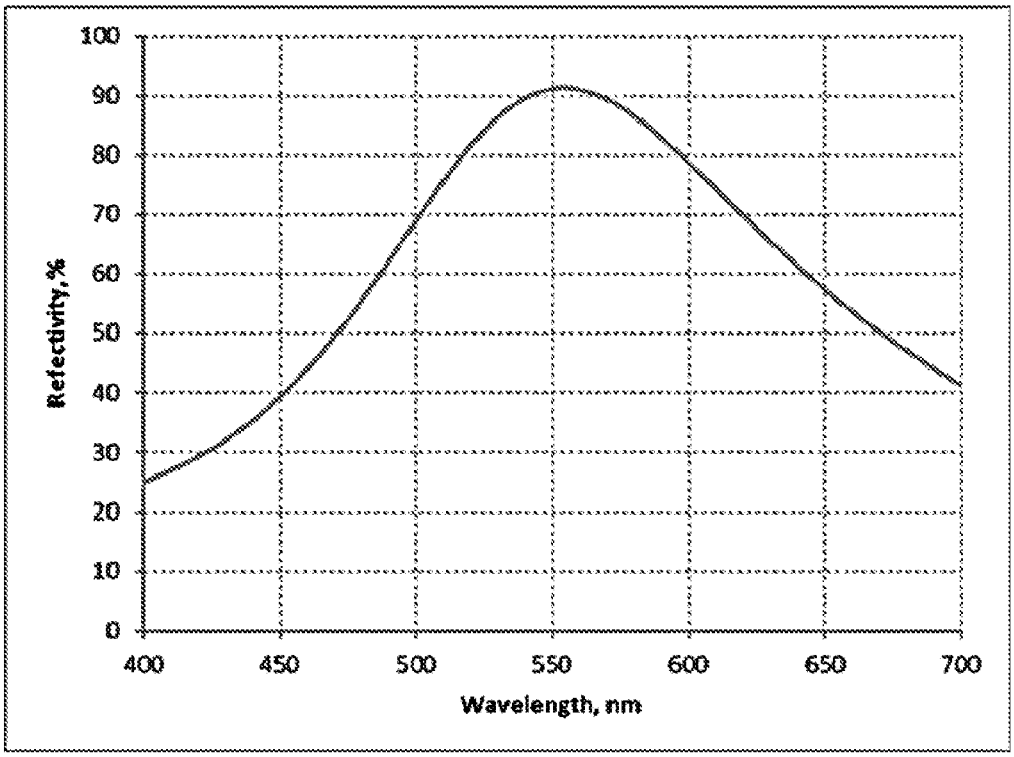
FIG. 2, including FIGS. 2A-2F, provides a set of graphical representations illustrating an example set of primaries in accordance with aspects of the present disclosure.
Figure 2B:
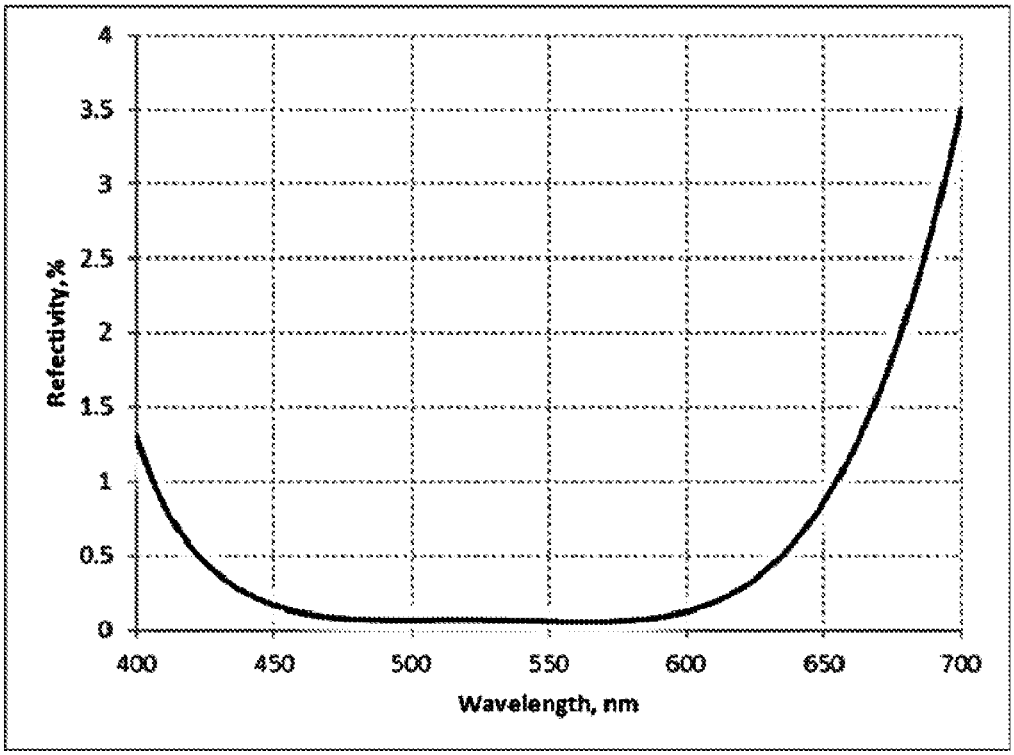
Figure 2C:
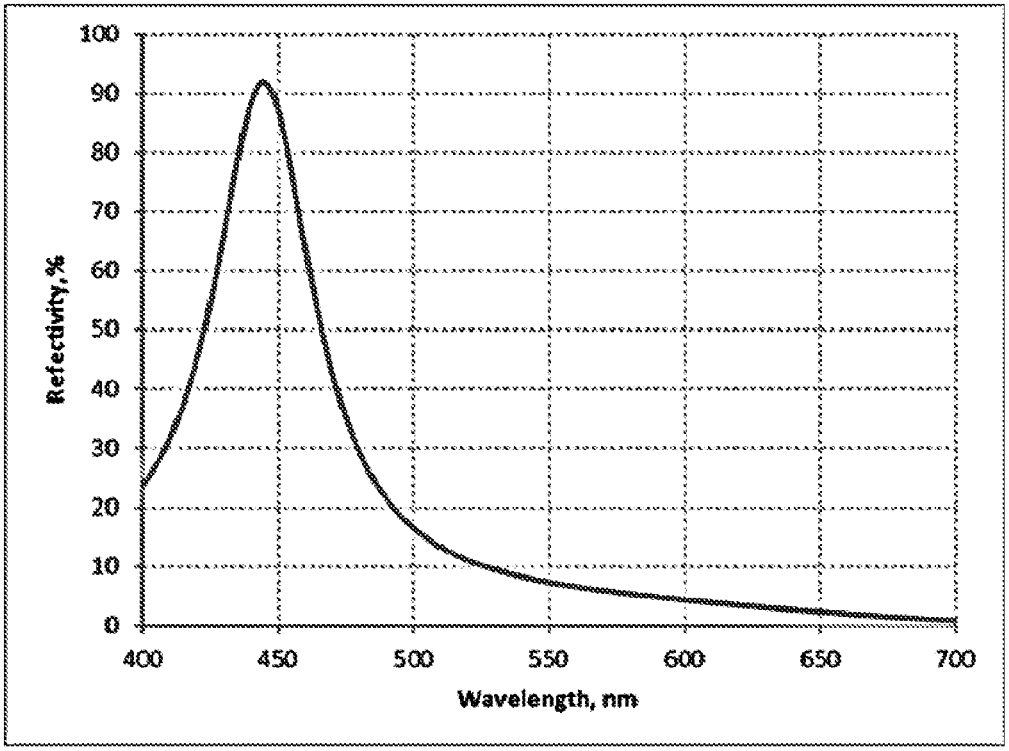
Figure 2D:
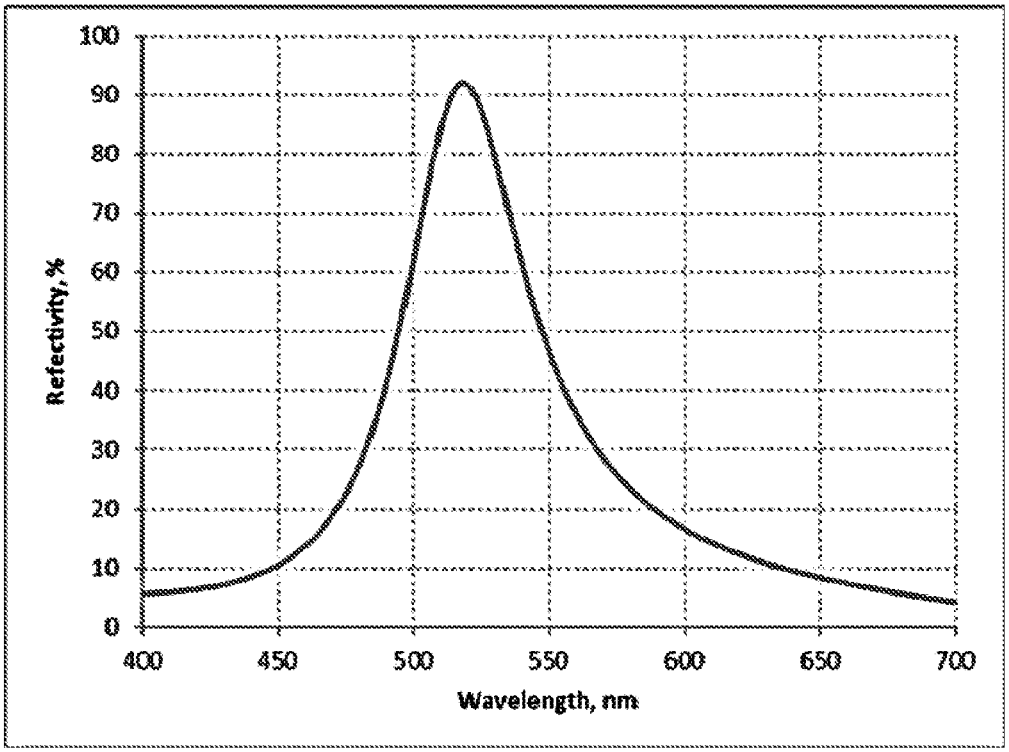
Figure 2E:
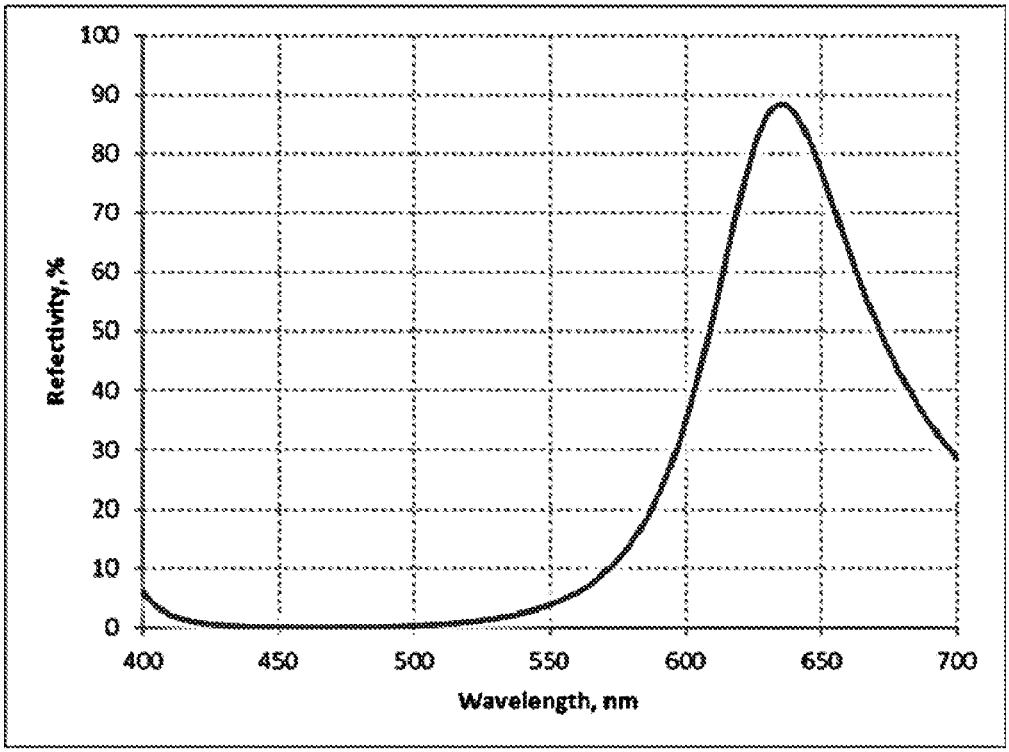
Figure 2F:
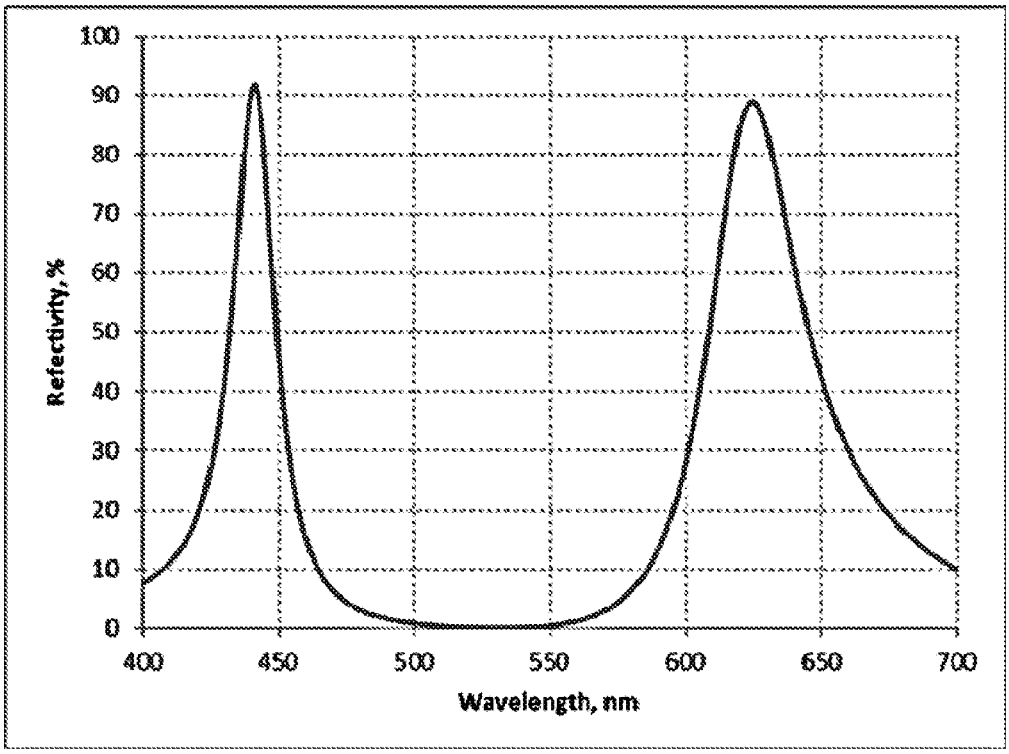

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

The present disclosure provides a solution to the problem of illuminant dependency for reflective displays. This solution capitalizes on the capability of reflective displays to use more primaries than emissive displays, and this solution preferably employs a set of six or more primaries to implement a new color reproduction process that reproduces a spectral curve of the originally imaged object(s). As mentioned above, with this new approach, the illuminant dependency of a source spectral color is the same as that produced by the reflective display, to the extent that the color is within the display color gamut. Thus, the color of a real object changed under different illuminant is the same as that produced by the display.

It is envisioned that this process may be implemented, for example, in reproductions of works of art, such as museum quality paintings. In such an application, a spectral image of the work of art may be created using, for example, a spectral scanner. This spectral image data may then be used by a reflective display, according to the presently disclosed process, to render a reproduction of the work of art that will replicate the appearance of the work of art under any current ambient lighting conditions. Because the reflective display reproduces the spectral curve of the imaged object, the display will change in appearance in varying lighting conditions in the same or similar way as the appearance of the original object would change under those conditions. This capability or characteristic is achieved without any need to sense, detect, measure, or adjust to the current ambient lighting conditions.

The concept of a spectral curve stems from the existence of three types of cones in human eyes for color vision. The spectral light distribution is integrated by cones in human eyes to form three signals for human color vision. The fundamental of colorimetric theory is based on this tri-chromatic theory, and the International Commission on Illumination (CIE) XYZ color space has become the basic color space for the numerical color vision model. This numerical color vision model has been successfully applied for color modeling and color characterization for human color vision.

The CIE has defined a set of three color-matching functions, called $\bar{x}(\lambda)$, $\bar{y}(\lambda)$, and $\bar{z}(\lambda)$, which can be thought of as the reconstruction of the spectral sensitivity curves of three linear detectors in human eyes that yield the CIE XYZ tristimulus values X, Y, and Z. The tabulated numerical values of these functions are known collectively as the CIE standard observer. The tristimulus values for a color with a color stimulus $\Phi(\lambda)$ are given in terms of the standard observer by:

$$X = k\sum_{\lambda}\Phi(\lambda)\cdot\bar{x}(\lambda)\cdot\Delta\lambda \tag{1}$$

$$Y = k\sum_{\lambda}\Phi(\lambda)\cdot\bar{y}(\lambda)\cdot\Delta\lambda \tag{2}$$

$$Z = k\sum_{\lambda}\Phi(\lambda)\cdot\bar{z}(\lambda)\cdot\Delta\lambda \tag{3}$$

where k is a constant to normalize the Y channel, $\lambda$, is the wavelength of the equivalent monochromatic light, $\Phi(\lambda)$ is the color stimulus function of the light seen by the observer, $\bar{x}(\lambda)$, $\bar{y}(\lambda)$, and $\bar{z}(\lambda)$ are the color-matching functions of the CIE 1931 standard colorimetric observer, and $\Delta\lambda$ is the wavelength sampling interval.

For non-self-luminous objects, the color-stimulus function is given by:

$$\Phi(\lambda)=R(\lambda)S(\lambda) \tag{4}$$

where $R(\lambda)$ is the spectral reflectance factor of the object, and $S(\lambda)$ is the relative spectral power distribution of the illuminant.

The above equations show that an object under different lighting conditions exhibit different colors to human eyes. This phenomenon is called metamerism. The colorimetric color characterization guarantees only color reproduction under a specific lighting condition. A system calibrated to an illuminant produces different colors under a different illuminant. If the purpose of color reproduction is to reproduce the colors of the original and to have the reproduced colors match the original colors independently of the illuminant, the spectral reflectance curves of the original and reproduced colors must be identical. Unfortunately, almost all modern color displays, including CRT displays, liquid crystal displays, LCD and LED displays, and existing reflective displays are designed for colorimetric color reproduction. This problem is especially serious for reflective display, because its color reproduction depends on illuminants. Under different illuminants, a reflective display may produce colors very differently.

Because of a very limited number of primaries (i.e., typically three) available on a display for producing colors, spectral color reproduction is impractical. However, since there are many primaries in an AiMOD display, a new process may be developed for spectral color reproduction. Applying the processes described below for AiMOD color processing, a reflective color display that reproduces spectral colors may be realized.

Because each pixel on an AiMOD display can only produce primary colors with fixed brightness (if the lighting condition is not changed), the display cannot natively produce different intensity levels. In order to produce different shapes of intensities, temporal modulation and spatial error diffusion may be applied. The new approach disclosed herein is different from conventional error diffusion that produces colors to be integrated by human eyes for colorimetric reproduction. Rather, the new approach matches the spectral reflectance of the imaged object(s) by reproducing the spectral reflectance curve of the image.

An advantage of this solution over conventional colorimetric reproduction is that it reproduces the spectral reflectance curve of the source instead of reproducing the colorimetric color of the source. As a result, the behavior of the color shift depending on the illuminant is emulated. The display device may prove especially applicable for high-fidelity color reproduction, which is especially useful in museums, paint shops, the fashion industry, the art industry, scientific demonstrations, etc.

Turning to FIG. 1, it is envisioned that, in some aspects, the display device 100 disclosed herein may have one or more processors 102 connected to a memory 104, a user interface 106, and input/output (I/O) interface 108. User interface 106 may include user interface input components (switches, touch screen regions, etc.), wired ports (e.g., USB, FIREWIRE®, etc.), and/or a wireless radio having a network interface (BLUETOOTH®, cellular, etc.). Processors 102 may access memory 104 to carry out data transfer via a device interface and/or communication port of I/O interface 108, and thereby receive spectral image data and store the data in a data region 110 of memory 104. Device drivers may be included in a data region of memory 104 for interfacing with spectral imaging devices, memory devices, or any other devices via I/O interface 108. Processors(s) 102 may additionally carry out instructions of an image processing application 112 residing in memory 104 in order to render the spectral image data stored in memory 104 to a reflective display, or other display, of user interface 106.

It is envisioned that a reflective display of user interface 106 may have a particular air gap that impacts display properties. A set or sets of primaries may be selected based on this air gap, and the device 100 may be configured with these sets of primaries in data region 110. Additionally, it is envisioned that a user may be permitted to select a level of performance in order to improve spectral reflectance reproduction accuracy or speed up image processing. For example, the level of performance may be configurable by a user via user input components of I/O interface 108. In this case, image processing application 112 may select a set of more or fewer primaries, respectively. For example, the application 112 may select a set of sixteen primaries for maximum spectral reproduction accuracy, and select a set of six primaries for maximum image processing speed. It should be understood that other numbers of primaries may be used, such as eight, ten, twelve, fourteen, or the like, primaries.

FIG. 2 shows an example of a set of six primaries produced with an AiMOD display. For example, FIG. 2A illustrates a white primary corresponding to an air gap of zero, and FIG. 2B illustrates a black primary corresponding to an air gap equal to 1170 Å. Additionally, FIG. 2C illustrates a first blue primary corresponding to an air gap equal to 2014 Å, and FIG. 2D illustrates a first green primary corresponding to an air gap equal to 2520 Å. Also, FIG. 2E illustrates a red primary corresponding to an air gap equal to 3363 Å, and FIG. 2F illustrates a magenta primary corresponding to an air gap equal to 6400 Å. Each pixel produces one of the primary colors at a time by changing the air-gap. The set of primary curves are used as a spectral base curve set for constructing input spectral curves. Because the intensity cannot be changed, the combinations of a primary set can only produce a very limited number of spectral colors. As will be introduce later, temporal modulation and/or spatial dithering are applied to produce different intensity levels for each primary.

Figure 3:
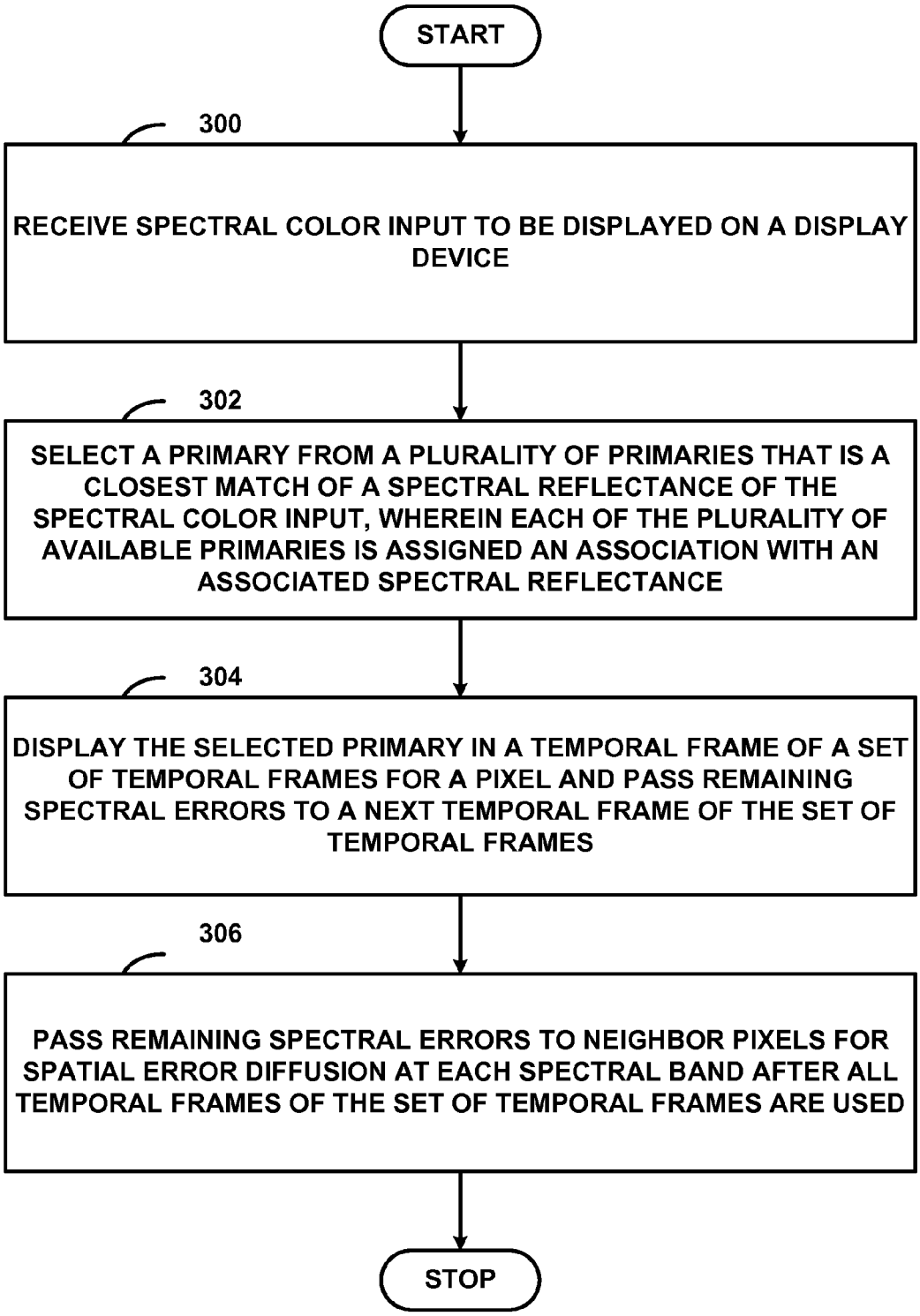
FIG. 3 illustrates example blocks of a spectral reproduction process in accordance with aspects of the present disclosure.

Turning now to FIG. 3, in operation, the image processing application may carry out a process in which, at block 300, spectral color input to be displayed on the display device is received. For example, block 300 may include receiving the spectral color input over a data interface or communication port. Alternatively or additionally, block 300 may include accessing a computer memory, reading the data out of the computer memory, and receiving the data as the spectral color input. Processing may proceed from block 300 to block 302.

At block 302, a primary may be selected from a plurality of available primaries that is a closest match of a spectral reflectance of the spectral color input, wherein each of the plurality of available primaries is assigned an association with an associated spectral reflectance. For example, block 304 may include selecting a primary that most closely matches a spectral reflectance of the modified input spectral color. Alternatively or additionally, block 304 may include finding a primary that matches the spectral color by minimizing a sum of squares of the spectral difference between the spectral reflectance of the input color and the spectral reflectance of each of the plurality of available primaries. Processing may proceed to block 304 from block 302.

At block 304, the selected primary may be displayed in a temporal frame of a set of temporal frames for a pixel, and remaining spectral errors may be passed to a next temporal frame of the set of temporal frames. For example, the primary may be displayed at a location of a pixel in a spectral image corresponding to the spectral image data. In some implementations, pixels may be processed one by one. For each pixel, a number of temporal frames may be used to reproduce the spectral curve of the imaged objects(s). In some implementations, the operations described above may be repeated for subsequent temporal frames until all of the available temporal frames have been processed. Also, passing remaining spectral errors to a next temporal frame of the set may include determining one or more of the remaining spectral errors between the selected primary of the temporal frame and the spectral reflectance of the spectral color. Additionally, passing remaining spectral errors to a next temporal frame of the set may include creating an adjusted spectral color including the one or more remaining spectral errors added to the spectral reflectance of the spectral color input. Further, passing remaining spectral errors to a next temporal frame of the set may include selecting a next primary from the plurality of primaries based on the adjusted spectral color. Finally, passing remaining spectral errors to a next temporal frame of the set may include displaying the selected next primary in the next temporal frame of the set of temporal frames. Processing may proceed from block 304 to block 306.

At block 306, remaining spectral errors may be passed to neighbor pixels for spatial error diffusion at each spectral band after all temporal frames of the set of temporal frames are used. For example, passing remaining spectral errors to neighbor pixels may include determining one or more of the remaining spectral errors after selection of primaries for each frame of the set of temporal frames. Additionally, passing remaining spectral errors to neighbor pixels may include performing spatial error diffusion of the remaining spectral errors to one or more neighbor colors of the spectral color input.

Figure 4:
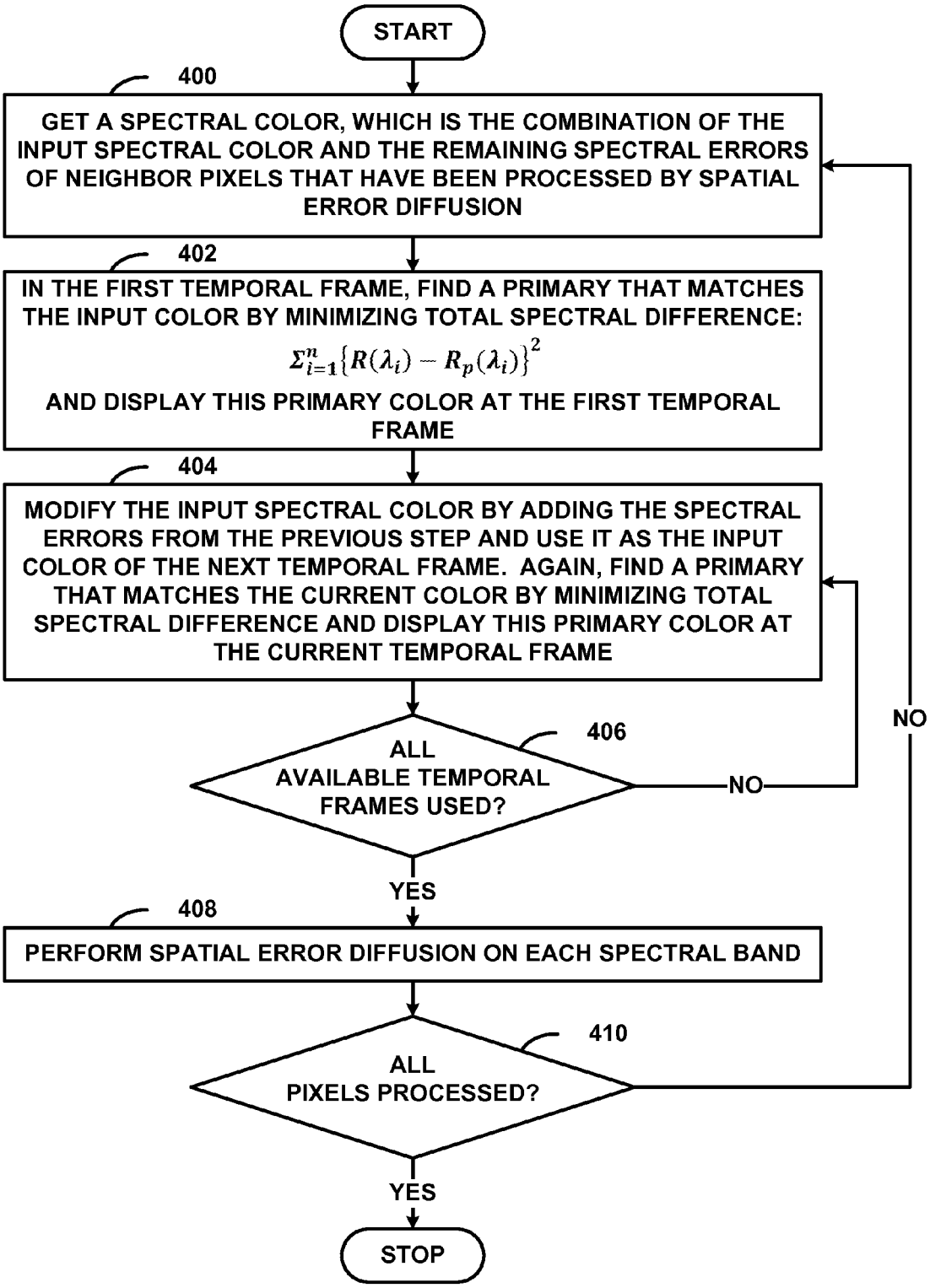
FIG. 4 illustrates example blocks of a spectral reproduction process for AiMOD displays in accordance with aspects of the present disclosure.

Turning now to FIG. 4, an implementation of a spectral color reproduction process for AiMOD displays is described in detail. At block 400, a spectral color may be received and combined with remaining spectral errors, if any, of neighbor pixels that have been processed by spatial error diffusion. The resulting spectral color may be used as an input spectral color for processing in rendering the current pixel in a first temporal frame. Processing may proceed from block 400 to block 402.

At block 402, a primary may be found that matches the input spectral color. For this process, the spectral reflectance, $R_i(\lambda_j)$, of each primary may be measured, where i is a primary and j is a spectral node. i=1, 2, . . . , p, where p is the number of primaries. j=1, 2, . . . , n, where n is the sampling number of spectral curves. This matching primary may be determined for an input spectral color, $r(\lambda_j)$, by minimizing the total spectral difference. For example, the sum of the square of the spectral difference may be minimized according to:

$$\Sigma_{j=1}^{n}[r(\lambda j)-Ri(\lambda j)]^2 \quad (5)$$

Once the matching primary is found, this primary may be displayed for the pixel in the first temporal frame, which may effectively designate or assign the primary for rendering to the AiMOD display in the first temporal frame at the location of the current pixel. Processing may proceed from block 402 to block 404.

At block 404, the remaining error of the spectral reflectance resulting from determining the primary for the pixel in the previous temporal frame may be added to the spectral reflectance of the current spectral color to form an adjusted spectral color according to:

$$r'(\lambda j)=r(\lambda j)+[r(\lambda j)-Ri(\lambda j)] \quad (6)$$

This modified spectral color may be used as an input spectral color for rendering the pixel in the next temporal frame. Again, a primary may be found that matches this input spectral color by minimizing the total spectral difference as described above, and this primary may be displayed for the pixel in the current temporal frame, which may effectively designate or assign the primary for rendering to the AiMOD display in the current temporal frame at the location of the current pixel. Processing may proceed from block 404 to block 406.

At block 406, a determination may be made whether there are any available temporal frames that remain unused. If a determination is made that there are available temporal frames that have not yet been used, then processing may return from block 406 to block 404 for the next temporal frame. However, if a determination is made that all of the temporal frames have been used, then processing may proceed from block 406 to block 408.

At block 408, spatial error diffusion may be performed on each spectral band. Remaining spectral errors from this operation, if any, may be passed to neighbor pixels. Processing proceeds from block 408 to block 410.

At block 410, a determination may be made whether all pixels have been processed. If a determination is made that not all pixels have been processed, then processing may return from block 410 to block 400 for processing of a next pixel. However, if a determination is made that all pixels have been processed, then processing may end, at which point the temporal frames having primaries for all pixels designated or assigned for display therein may be rendered to the AiMOD display.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed is:

1. A method for color reproduction in a display device having at least one processor, the method comprising:

receiving, with the at least one processor, spectral color input to be displayed on the display device;

selecting, with the at least one processor, a primary from a plurality of available primaries that is a closest match of a spectral reflectance of the spectral color input, wherein each of the plurality of available primaries has an associated spectral reflectance;

displaying the selected primary in a temporal frame of a set of temporal frames for a pixel and passing to a next temporal frame of the set of temporal frames, one or more spectral errors between the spectral reflectance of the selected primary of the temporal frame and the spectral reflectance of the spectral color input;

repeating passing, with the at least one processor, the one or more spectral errors to a next temporal frame until all temporal frames of the set of temporal frames for the pixel are used; and passing, with the at least one processor, remaining spectral errors to neighbor pixels for spatial error diffusion at each spectral band after all temporal frames of the set of temporal frames for the pixel are used.

2. The method of claim 1, wherein the closest match is determined by minimizing a sum of squares of the spectral difference between the spectral reflectance of the input color and the spectral reflectance of each of the plurality of available primaries.

3. The method of claim 2, wherein passing the one or more spectral errors to a next temporal frame of the set further comprises:

determining the one or more spectral errors between spectral reflectance of the selected primary of the temporal frame and the spectral reflectance of the spectral color input;

creating an adjusted spectral color including the one or more remaining spectral errors added to the spectral reflectance of the spectral color input;

selecting a next primary from the plurality of primaries based on the adjusted spectral color; and displaying the selected next primary in the next temporal frame of the set of temporal frames.

4. The method of claim 3, wherein passing remaining spectral errors to neighbor pixels further comprises:

determining one or more of the remaining spectral errors after selection of primaries for each frame of the set of temporal frames; and performing spatial error diffusion of the remaining spectral errors to one or more neighbor colors of the spectral color input.

5. The method of claim 1, further comprising:

employing a set of six or more available primaries.

6. The method of claim 1, further comprising:

employing a set of ten or more available primaries.

7. The method of claim 1, further comprising:

employing a set of sixteen or more available primaries.

8. The method of claim 1, further comprising:

selecting a set of available primaries based on a user selected configuration of the display device.

9. The method of claim 1, further comprising:

selecting a set of available primaries based on available air gaps of a reflective display of the display device.

10. The method of claim 9, wherein the reflective display is an AiMOD display.

11. An apparatus for color reproduction in a display device, comprising:

means for receiving spectral color input to be displayed on the display device;

means for selecting a primary from a plurality of available primaries that is a closest match of a spectral reflectance of the spectral color input, wherein each of the plurality of available primaries has an associated spectral reflectance;

means for displaying the selected primary in a temporal frame of a set of temporal frames for a pixel and passing to a next temporal frame of the set of temporal frames, one or more spectral errors between the spectral reflectance of the selected primary of the temporal frame and the spectral reflectance of the spectral color input;

means for repeating passing the one or more spectral errors to a next temporal frame until all temporal frames of the set of temporal frames for the pixel are used; and means for passing remaining spectral errors to neighbor pixels for spatial error diffusion at each spectral band after all temporal frames of the set of temporal frames for the pixel are used.

12. The apparatus of claim 11, further comprising:

means for determining the closest match by minimizing a sum of squares of the spectral difference between the spectral reflectance of the input color and the spectral reflectance of each of the plurality of available primaries.

13. The apparatus of claim 12, wherein the means for passing the one or more spectral errors to a next temporal frame of the set further comprises:

means for determining the one or more spectral errors between spectral reflectance of the selected primary of the temporal frame and the spectral reflectance of the spectral color input;

means for creating an adjusted spectral color including the one or more remaining spectral errors added to the spectral reflectance of the spectral color input;

means for selecting a next primary from the plurality of primaries based on the adjusted spectral color; and means for displaying the selected next primary in the next temporal frame of the set of temporal frames.

14. The apparatus of claim 13, wherein the means for passing remaining spectral errors to neighbor pixels further comprises:

means for determining one or more of the remaining spectral errors after selection of primaries for each frame of the set of temporal frames; and means for performing spatial error diffusion of the remaining spectral errors to one or more neighbor colors of the spectral color input.

15. The apparatus of claim 11, further comprising:

means for employing a set of six or more available primaries.

16. The apparatus of claim 11, further comprising:

means for employing a set of ten or more available primaries.

17. The apparatus of claim 11, further comprising:

means for employing a set of sixteen or more available primaries.

18. The apparatus of claim 11, further comprising:

means for selecting a set of available primaries based on a user selected configuration of the display device.

19. The apparatus of claim 11, further comprising:

means for selecting a set of available primaries based on available air gaps of a reflective display of the display device.

20. The apparatus of claim 19, wherein the reflective display is an AiMOD display.

21. A computer program product comprising:

a non-transitory computer-readable medium containing code for controlling one or more processors, the code comprising:

code for receiving spectral color input to be displayed on the display device;

code for selecting a primary from a plurality of available primaries that is a closest match of a spectral reflectance of the spectral color input, wherein each of the plurality of available primaries has an associated spectral reflectance;

code for displaying the selected primary in a temporal frame of a set of temporal frames for a pixel and passing to a next temporal frame of the set of temporal frames, one or more spectral errors between the spectral reflectance of the selected primary of the temporal frame and the spectral reflectance of the spectral color input;

code for repeating passing the one or more spectral errors to a next temporal frame until all temporal frames of the set of temporal frames for the pixel are used and code for passing remaining spectral errors to neighbor pixels for spatial error diffusion at each spectral band after all temporal frames of the set of temporal frames for the pixel are used.

22. The computer program product of claim 21, wherein the computer-readable medium further comprises:

code for determining the closest match by minimizing a sum of squares of the spectral difference between the spectral reflectance of the input color and the spectral reflectance of each of the plurality of available primaries.

23. The computer program product of claim 22, wherein the code for passing the one or more spectral errors to a next temporal frame of the set further comprises:

code for determining the one or more spectral errors between spectral reflectance of the selected primary of the temporal frame and the spectral reflectance of the spectral color input;

code for creating an adjusted spectral color including the one or more remaining spectral errors added to the spectral reflectance of the spectral color input;

code for selecting a next primary from the plurality of primaries based on the adjusted spectral color; and code for displaying the selected next primary in the next temporal frame of the set of temporal frames.

24. The computer program product of claim 23, wherein the means for passing remaining spectral errors to neighbor pixels further comprises:

code for determining one or more of the remaining spectral errors after selection of primaries for each frame of the set of temporal frames; and code for performing spatial error diffusion of the remaining spectral errors to one or more neighbor colors of the spectral color input.

25. The computer program product of claim 21, wherein the computer-readable medium further includes:

code for causing a computer to employ a set of six or more available primaries.

26. The computer program product of claim 21, wherein the computer-readable medium further includes:

code for causing a computer to employ a set of ten or more available primaries.

27. The computer program product of claim 21, wherein the computer-readable medium further includes:

code for causing a computer to employ a set of sixteen or more available primaries.

28. The computer program product of claim 21, wherein the computer-readable medium further includes:

code for causing a computer to select a set of available primaries based on a user selected configuration of the display device.

29. The computer program product of claim 21, wherein the computer-readable medium further includes:

code for causing a computer to select a set of available primaries based on available air gaps of a reflective display device.

30. The computer program product of claim 29, wherein the reflective display is an AiMOD display.

31. A display device, comprising:

at least one processor; and a memory coupled to said at least one processor, wherein said at least one processor is configured to:

receive spectral color input to be displayed on the display device in a set of temporal frames;

select a primary from a plurality of available primaries that is a closest match of a spectral reflectance of the spectral color input, wherein each of the plurality of available primaries has an associated spectral reflectance;

display the selected primary in a temporal frame of a set of temporal frames for a pixel and pass to a next temporal frame of the set of temporal frames, one or more spectral errors between the spectral reflectance of the selected primary of the temporal frame and the spectral reflectance of the spectral color input; and pass remaining spectral errors to neighbor pixels for spatial error diffusion at each spectral band after all temporal frames of the set of temporal frames for the pixel are used.

32. The display device of claim 31, wherein the closest match is determined by minimizing a sum of squares of the difference between the spectral reflectance of the spectral color input and the spectral reflectance of each of the plurality of available primaries.

33. The display device of claim 32, wherein said at least one processor is further configured to pass remaining spectral errors to a next temporal frame of the set by:

determining the one or more spectral errors between spectral reflectance of the selected primary of the temporal frame and the spectral reflectance of the spectral color input;

creating an adjusted spectral color including the one or more remaining spectral errors added to the spectral reflectance of the spectral color input;

selecting a next primary from the plurality of primaries based on the adjusted spectral color; and displaying the selected next primary in the next temporal frame of the set of temporal frames.

34. The display device of claim 33, wherein said at least one processor is further configured to:

determine one or more of the remaining spectral errors after selection of primaries for each frame of the set of temporal frames; and perform spatial error diffusion of the remaining spectral errors to one or more neighbor colors of the spectral color input.

35. The display device of claim 31, wherein said at least one processor is further configured to:

employ a set of six or more available primaries.

36. The display device of claim 31, wherein said at least one processor is further configured to:

employ a set of ten or more available primaries.

37. The display device of claim 31, wherein said at least one processor is further configured to:

employ a set of sixteen or more available primaries.

38. The display device of claim 31, wherein said at least one processor is further configured to:

select a set of available primaries based on a user selected configuration of the display device.

39. The display device of claim 31, wherein said at least one processor is further configured to:

select a set of available primaries based on available air gaps of a reflective display device.

40. The display device of claim 39, wherein the reflective display is an AiMOD display.

* * * * *